US009092045B2

(12) United States Patent
Nascimento

(10) Patent No.: US 9,092,045 B2
(45) Date of Patent: Jul. 28, 2015

(54) STARTUP CIRCUITS WITH NATIVE TRANSISTORS

(71) Applicant: Freescale Semiconductor, Inc., Austin, TX (US)

(72) Inventor: Ivan Carlos Ribeiro Nascimento, Campinas (BR)

(73) Assignee: Freescale Semiconductor, Inc., Austin, TX (US)

( * ) Notice: Subject to any disclaimer, the term of this patent is extended or adjusted under 35 U.S.C. 154(b) by 236 days.

(21) Appl. No.: 13/865,794

(22) Filed: Apr. 18, 2013

(65) Prior Publication Data

US 2014/0312875 A1 Oct. 23, 2014

(51) Int. Cl.

| | |
|---|---|
| ***G05F 3/16*** | (2006.01) |
| ***G05F 3/20*** | (2006.01) |
| ***G05F 3/30*** | (2006.01) |

(52) U.S. Cl.
CPC ..... *G05F 3/30* (2013.01)

(58) Field of Classification Search
USPC ..... 323/312–314, 901
See application file for complete search history.

(56) References Cited

U.S. PATENT DOCUMENTS

| | | | | |
|---|---|---|---|---|
| 4,970,408 | A | 11/1990 | Hanke et al. | |
| 5,867,013 | A * | 2/1999 | Yu | 323/314 |
| 5,903,141 | A * | 5/1999 | Tailliet | 323/312 |
| 5,936,444 | A | 8/1999 | Pathak et al. | |
| 7,208,929 | B1 * | 4/2007 | Rabeyrin et al. | 323/313 |
| 7,531,999 | B2 * | 5/2009 | Chang | 323/317 |
| 8,085,019 | B2 * | 12/2011 | Cho et al. | 323/281 |
| 8,324,944 | B2 * | 12/2012 | Schindler | 327/143 |
| 8,704,506 | B2 * | 4/2014 | Lipka et al. | 323/303 |

* cited by examiner

*Primary Examiner* — Adolf Berhane
*Assistant Examiner* — Gary Nash
(74) *Attorney, Agent, or Firm* — Luiz von Paumgartten; Fogarty, L.L.C.

(57) ABSTRACT

Startup circuits with native transistors. In some embodiments, a startup circuit may include a first inverter configured to receive a bandgap voltage ($V_{bg}$) from a bandgap reference circuit and to produce an output voltage ($V_{OUT}$), and a second inverter operably coupled to the first inverter to form a latch, the latch configured to maintain a value of $V_{OUT}$, the second inverter including a native transistor, the native transistor having a gate terminal coupled to $V_{OUT}$ and a source terminal coupled to $V_{bg}$. In other embodiments, a method may include receiving $V_{bg}$ at a startup circuit and outputting $V_{OUT}$ configured to change in response to $V_{bg}$ rising above $V_{trig}$ or falling below $V_{trig}$, where the power consumption of the startup circuit is based at least in part upon a voltage value applied to a source terminal of a native transistor within the startup circuit.

19 Claims, 7 Drawing Sheets

100

300

400

600

500

700

STARTUP CIRCUITS WITH NATIVE TRANSISTORS

FIELD

This disclosure relates generally to electronic devices, and more specifically, to startup circuits with native transistors.

BACKGROUND

Complementary Metal-Oxide Semiconductor (CMOS) technology is commonly used to manufacture integrated circuits (ICs). Examples of modern ICs include microprocessors, microcontrollers, memories, etc. In various implementations, one or more components within an IC may operate based upon one or more "voltage references." To provide these voltage references, one or more "reference circuits" may be designed within the IC.

An example of a reference circuit is the "bandgap circuit." A bandgap circuit is configured to output a temperature independent voltage reference with a value of approximately 1.25 V, or another value suitably close to the theoretical 1.22 eV bandgap of silicon at 0 K—that is, the energy required to promote an electron from its valence band to its conduction band to become a mobile charge. For example, a bandgap circuit may include a set of Self-Cascade MOS Field-Effect Transistor (SCM) structures and one or more bipolar transistor(s) operating in an open loop configuration.

Also, in some cases, a reference circuit may employ a startup circuit or the like. Generally speaking, a startup circuit is configured to ensure that the reference circuit is operating in desired or known states.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity and have not necessarily been drawn to scale.

DETAILED DESCRIPTION

The term "startup circuit," as used herein, describes a circuit configured to initialize and/or condition the output of another circuit, such as a reference voltage circuit or the like. For example, a startup circuit may be configured to provide a signal to a bandgap circuit in response to the output voltage of the bandgap circuit being smaller than a predetermined voltage level, which is referred to as a "trigger voltage level" or "$V_{trig}$." The signal provided to the bandgap circuit is configured to help initialize and/or stabilize its output. Of particular benefit is an increase in the speed at which the output of the bandgap circuit reaches its ultimately desired voltage level. When the output of the bandgap circuit nearly reaches $V_{trig}$, the startup circuit may be disabled and thus not involved with the bandgap circuit's operation; at least until the output of the bandgap circuit again drops below $V_{trig}$.

In some implementations, a startup circuit as described herein may be configured to operate with very little or no current consumption other than leakage effects. Also, in certain implementations, a startup circuit may be configured to operate without a capacitive coupling between the startup circuit and a bandgap circuit, particularly when voltage variations have slow slew rates.

The term "native transistor" (also known as a "natural transistor") refers to a type of Metal-Oxide-Semiconductor Field-Effect Transistor (MOSFET) that has a zero or near-zero threshold voltage ($V_{th}$). Whereas the gate-to-source voltage ($V_{gs}$) of a normal n-type MOS (NMOS) transistor has to reach a non-zero, threshold voltage value (e.g., between approximately 0.5 V and 0.8 V) before the transistor becomes conductive, thus allowing current to flow from its drain to its source, a native NMOS transistor becomes conductive with a $V_{gs}$ of approximately 0 V. When a higher voltage (e.g., approximately 0.6 V) is applied to the source terminal of a native NMOS transistor, however, the native NMOS transistor operates similarly to a normal NMOS transistor.

Figure 1:
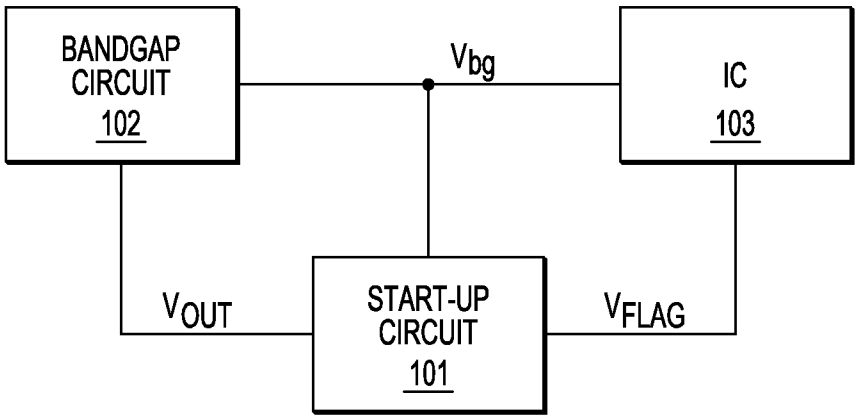
FIG. 1 is a high-level block diagram of an example of an Integrated Circuit (IC) according to some embodiments.

Turning now to FIG. 1, a high-level block diagram of an example of an Integrated Circuit (IC) is depicted according to some embodiments. As illustrated, circuit 100 includes IC 103, bandgap circuit 102, and startup circuit 101. IC 103 is configured to operate based, at least in part, upon a temperature independent voltage reference value $V_{bg}$ provided by bandgap circuit 102. In some situations, a first output $V_{OUT}$ of startup circuit 101 is configured to initialize, condition, and/or stabilize the value of $V_{bg}$. A second output $V_{FLAG}$ is used to notify IC 103 of the status of $V_{bg}$.

In operation, in response to $V_{bg}$ being smaller than $V_{trig}$ either during initialization or at a later time, $V_{OUT}$ may be provided to a current source within or otherwise coupled to bandgap circuit 102 to boost the value of $V_{bg}$, and $V_{FLAG}$ may be set to a logic low. When the output of bandgap circuit 102 meets and/or surpasses $V_{trig}$, startup circuit 101 may be turned off and its output $V_{OUT}$ set to 0 V (or otherwise decoupled from bandgap circuit 102), and $V_{FLAG}$ may be set to a logic high. In some embodiments, startup circuit 101 may be automatically rearmed such that, upon the value of $V_{bg}$ dropping below $V_{trig}$, startup circuit 101 again provides a $V_{OUT}$ value configured to stabilize $V_{bg}$. These and other circuits and operations are described in more detail in connection with FIGS. 2-6 below.

Figure 7:
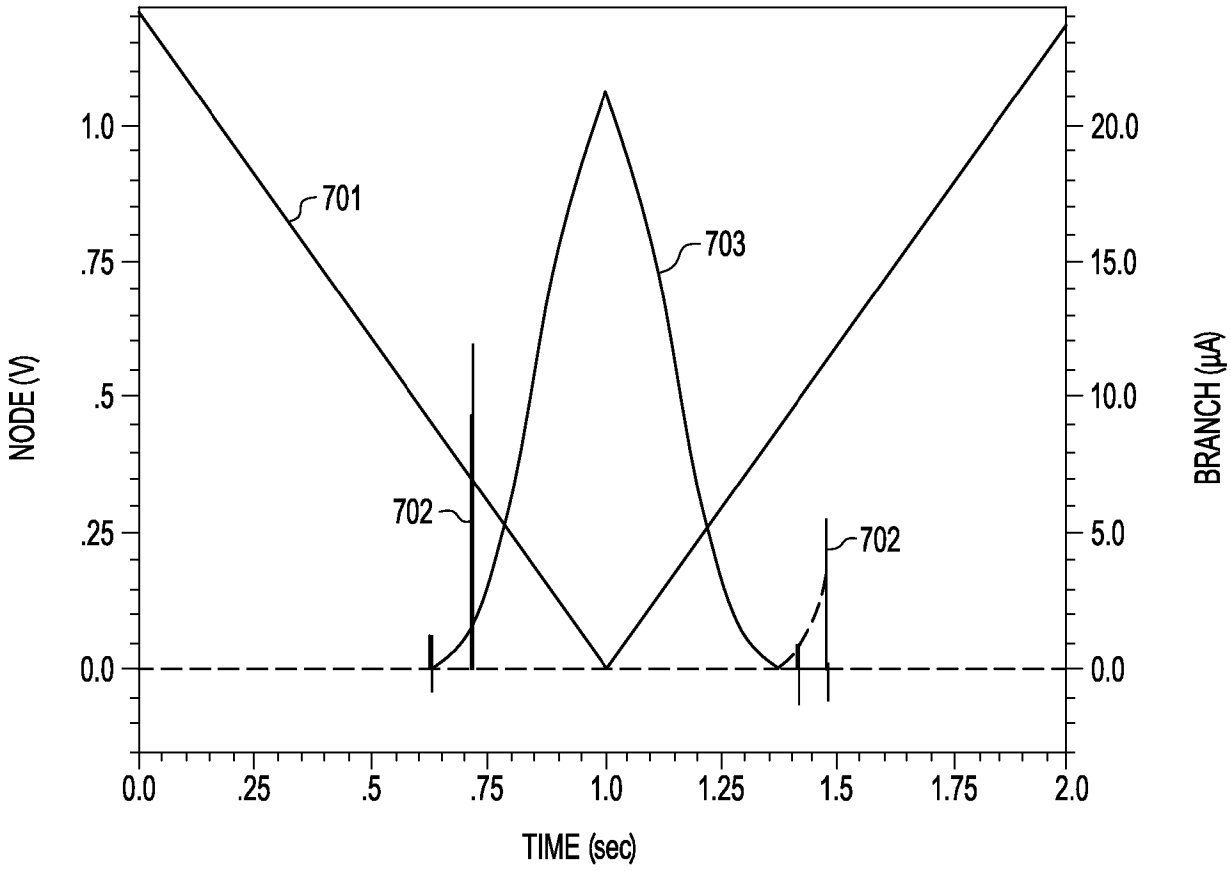
FIG. 7 is a graph showing the current consumption of different startup circuits as a function of their input voltages according to some embodiments.

In some applications, the power consumption of startup circuit 101 may be approximately zero, with a very small amount of consumption due to leakage effects. In other applications, the power consumption of startup circuit 101 may be significant only during times when $V_{OUT}$ transitions between different values. In yet other applications, the power consumption of startup circuit 101 may be significant only while $V_{bg}$ is below $V_{trig}$. These and other power consumption features are illustrated in FIG. 7.

It should be noted that, although FIG. 1 shows blocks 101-103 as distinct blocks, in various implementations two or more of blocks 101-103 may be combined into a single integrated circuit within an electronic chip. An example of such an electronic chip is discussed in connection with FIG. 8.

Figure 2:
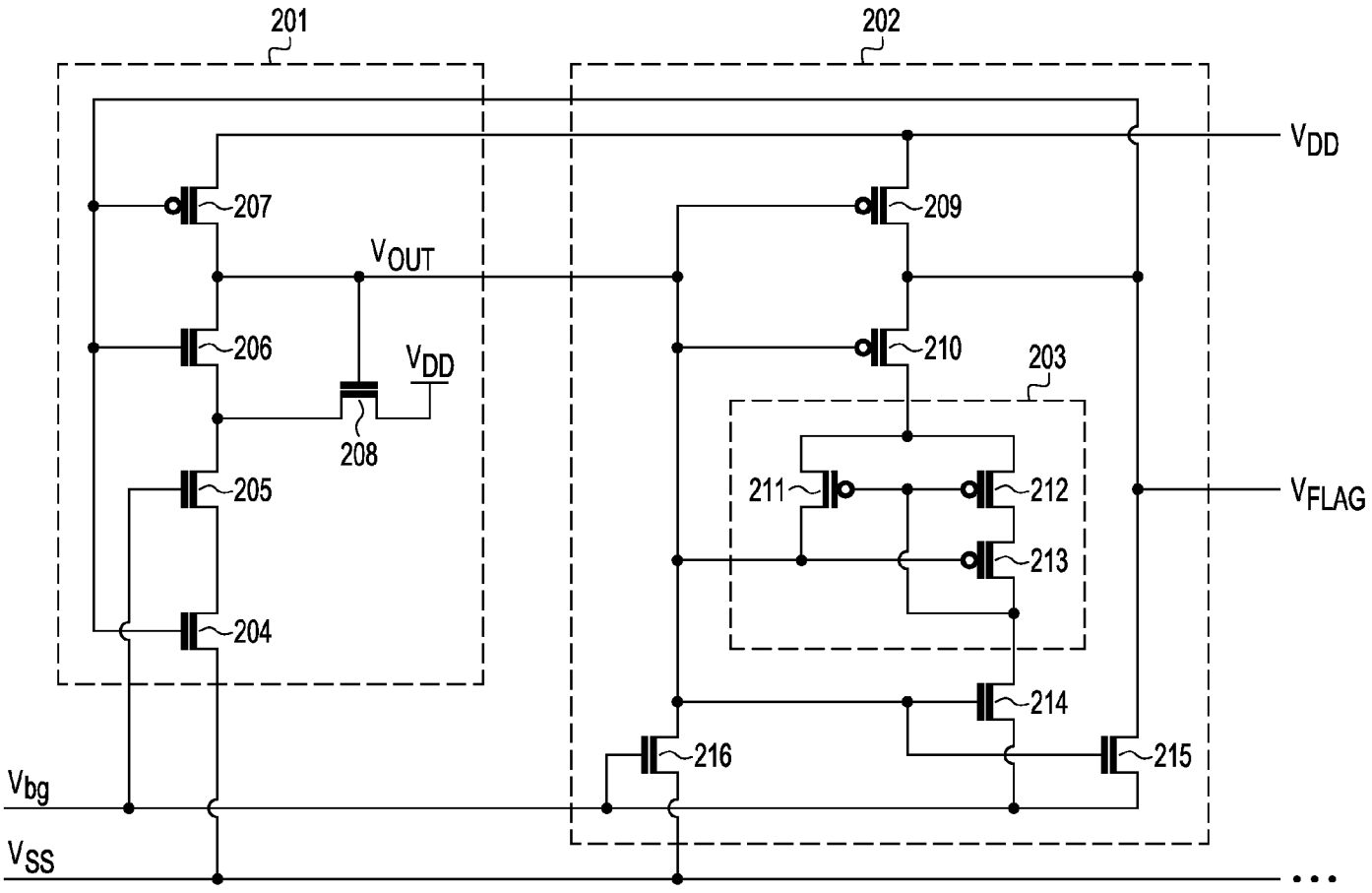
FIG. 2 is a circuit diagram of an example of a startup circuit according to some embodiments.

FIG. 2 is a circuit diagram of an example of startup circuit 200. In some embodiments, startup circuit 200 may be used as block 101 in FIG. 1. Startup circuit 200 operates based upon voltage bus $V_{DD}$ and reference bus (ground) $V_{SS}$. As illustrated, startup circuit 200 has one analog input $V_{bg}$ and two logic outputs $V_{OUT}$ and $V_{FLAG}$. As discussed above, here $V_{bg}$ is the output of bandgap circuit 102 (of FIG. 1) and $V_{OUT}$ is the output of startup circuit 200 used by bandgap circuit 102 to boost the value of $V_{bg}$, for example, by turning on a current source when asserted. Moreover, $V_{FLAG}$ is configured to indicate when $V_{bg}$ has reached a selected $V_{bg}$ and therefore is ready to be used, for example, by IC 103.

In this example, $V_{DD}$=5 V and $V_{SS}$=0 V. The value of $V_{bg}$ varies between 0 V and approximately 1.2 V. Also, in this case, $V_{trig}$ is selected to have a value of approximately 0.5 V. In other implementations, however, other voltage values may be used.

Generally speaking, circuit 200 works as a two-inverter latch with first inverter 201 operably coupled to second inverter 202. Second inverter 202 includes current mirror 203 as well as two native transistors 214 and 215. All other transistors 204-213 and 216 are normal transistors.

First inverter includes PMOS transistor 207 and NMOS transistors 204-206 and 208. The node between the drains of transistors 206/207 and second inverter 202 provides $V_{OUT}$. Also, $V_{OUT}$ is used as an input to second inverter 202, and the output of second inverter 202 yields $V_{FLAG}$, which in turn is coupled to the gates of transistors 204, 206, and 207 in first inverter 201. Second inverter 203 includes PMOS transistors 209-213, and NMOS transistors 214-216.

In operation, startup circuit 200 is configured to transition between two states, as illustrated in Table I below:

TABLE I

| | State 1 | State 2 |
|---|---|---|
| $V_{bg}$ | $<V_{trig}$ | $>V_{trig}$ |
| $V_{OUT}$ | 5 V | 0 V |
| $V_{FLAG}$ | 0 V | 5 V |

When in state 1, $V_{bg}$ is below $V_{trig}$, and therefore both NMOS transistors 205 and 216 are turned off. Native NMOS transistor 215 pulls $V_{FLAG}$ down to 0 V, native NMOS transistor 214 pulls the drain of PMOS transistor 213 down, and PMOS 211 pulls the $V_{OUT}$ voltage up. When $V_{OUT}$ voltage is close to $V_{DD}$, PMOS transistors 209 and 210 of second inverter 202 are turned off. Importantly, your is at 5 V, thus boosting bandgap circuit 102 (in FIG. 1) and helping raise the value of $V_{bg}$. Also, native NMOS transistors 214 and 215 ensure that $V_{FLAG}$ is in a low logic state when $V_{bg}$ is below $V_{trig}$.

For example, when $V_{bg}$ is at 0 V, NMOS transistors 205 and 216 are turned off ($V_{gs}<V_{th}$) and all paths that could have some pull down effect on $V_{OUT}$ are in high impedance. Because native NMOS transistors 214 and 215 can have currents with $V_{gs}$=0 V, these transistors have drain-source currents. Native NMOS transistor 215's pulls down $V_{FLAG}$, but, in order for that voltage to go down, PMOS transistor 209 is made non-conductive.

If PMOS transistor 209 is already off, $V_{FLAG}$ goes down and PMOS transistor 207 is turned on, providing a pull up current for $V_{OUT}$ and keeping this state stable. Conversely, if PMOS transistor 209 is turned on, native NMOS transistor 215 may not be able to pull down the $V_{FLAG}$ node alone. In this case, however, native NMOS transistor 214 transistor has a current path to $V_{DD}$ through NMOS transistor 209, NMOS transistor 210, and current mirror 203, and therefore a pull up current pulls up $V_{OUT}$ until NMOS transistor 209 starts to turn off. After NMOS transistor 209 becomes weaker than native NMOS transistor 215, $V_{FLAG}$ drops and NMOS transistor 207 turns on, thus pulling up $V_{OUT}$ voltage to $V_{DD}$ more quickly. Also, current mirror 203 ensures that circuit 200 is rearmed—i.e., $V_{OUT}$ is set to 5 V and $V_{FLAG}$ is set to 0 V—when $V_{bg}$ drops below $V_{trig}$.

As $V_{bg}$ rises, it eventually overcomes the value of $V_{trig}$, thus causing circuit 200 to transition into state 2. In state 2, NMOS transistors 205 and 216 are both turned on. PMOS transistors 209 and 210 of second inverter 202 are also turned on. Also, in this state, native NMOS transistors 214 and 215 have their source voltages at $V_{trig}$ or higher, and therefore act as normal transistors insofar as they may be made non-conductive. Thus, because $V_{OUT}$ is close to 5 V, native NMOS transistors 214 and 215 are both weakened and NMOS transistor 216 is designed to pull down the $V_{OUT}$ voltage low enough to turn on PMOS transistor 209 in a manner sufficient to pull up the $V_{FLAG}$ voltage up and complete the transition. When the transition is complete, native NMOS transistors 214 and 215 are turned off since their gates are at 0 V and their sources are above $V_{trig}$.

For instance, when $V_{bg}$ rises, native NMOS transistors 214 and 215 are weakened, and $V_{FLAG}$ has less pull down current. NMOS transistor 207 is turned on, and so is NMOS transistor 216. As $V_{bg}$ increases, $V_{OUT}$ decreases. When $V_{OUT}$ is low enough to turn on NMOS transistor 209, $V_{FLAG}$ is pulled up to $V_{DD}$, which in turn turns off NMOS transistor 207. Accordingly, $V_{OUT}$ is pulled down to 0 V. Similarly as discussed above, here when the transition is complete, native NMOS transistors 214 and 215 are turned off.

Incidentally, it should be noted that there is no current path between $V_{DD}$ and $V_{SS}$ when startup circuit is either in state 1 or state 2. When operating in state 1, $V_{bg}$ is smaller than $V_{th}$, hence NMOS transistors 205 and 216 are turned off. When in state 2, $V_{OUT}$ is kept at 0 V, and because the sources of native NMOS transistors 214 and 215 are at $V_{trig}$ or higher, circuit 200 is capable of turning off native NMOS transistors 214 and 215. As such, whether in state 1 or state 2, there is no current flowing between $V_{DD}$ and $V_{SS}$. Accordingly, the power consumption of startup circuit 200 is equal to zero, excluding leakage effects, at all times except during $V_{OUT}$'s transitions between high and low logic values, as shown in FIG. 7.

Figure 3:
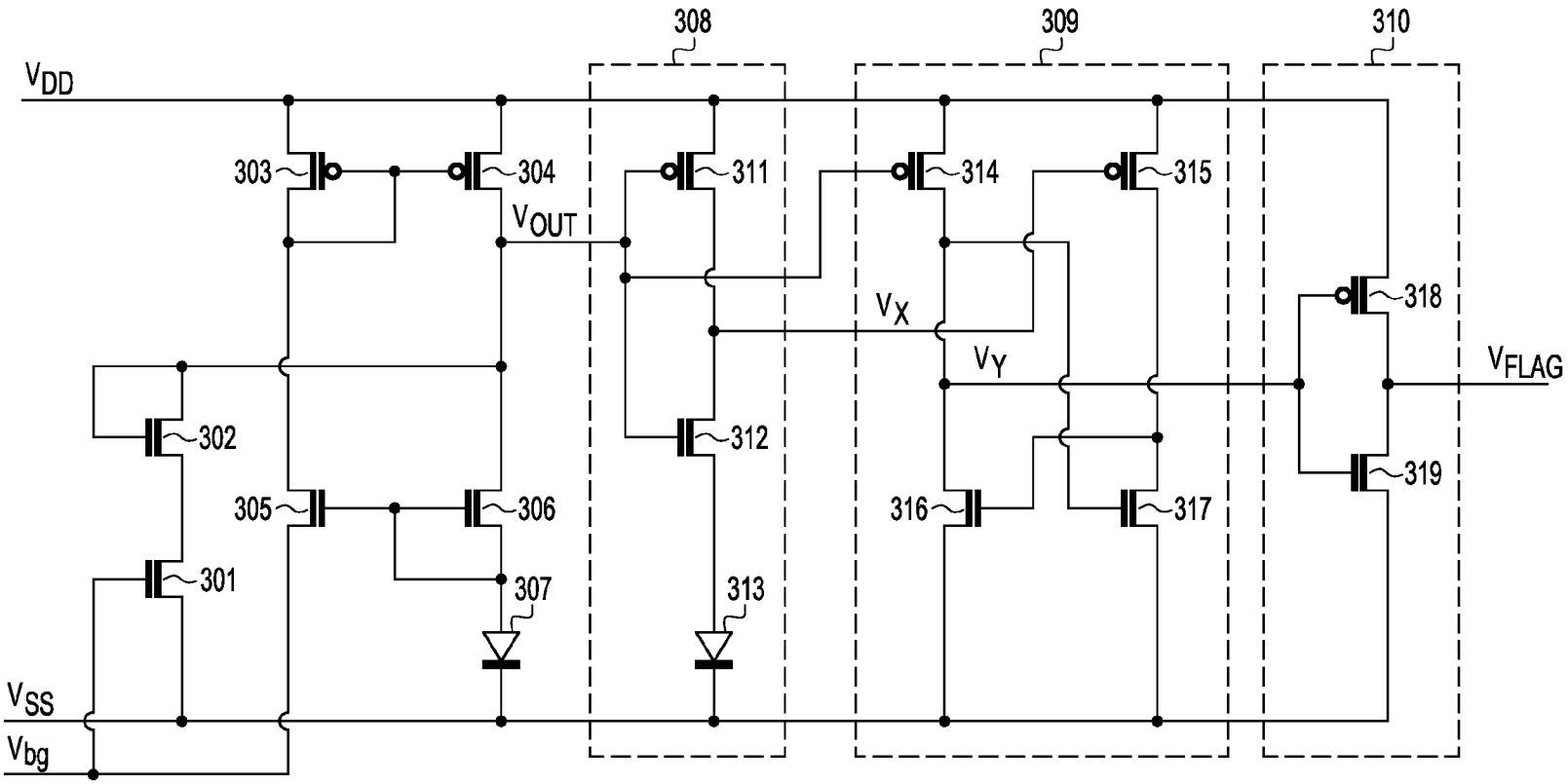
FIG. 3 is a circuit diagram of an example of another startup circuit according to some embodiments.

FIG. 3 is a circuit diagram of an example of another startup circuit 300. In some embodiments, startup circuit 300 may be used as block 200 in FIG. 1. Startup circuit 300 again operates based upon voltage bus $V_{DD}$ and reference bus (ground) $V_{SS}$. As illustrated, startup circuit 300 also includes two native NMOS transistors 305 and 306, and all other transistors are normal transistors.

In this implementation, NMOS transistors 305 and 306 are in a mirror configuration with their respective gates operably coupled to each other. Also, PMOS transistors 303 and 304 implement another current mirror. Blocks 308-310 are configured to perform signal conditioning operations in order to produce $V_{FLAG}$. Specifically, block 308 is an inverter with PMOS transistor 311, NMOS transistor 312, and diode 313; block 309 is a level-shifter with PMOS transistors 314 and 315 as well as NMOS transistors 316 and 317; and block 310 is another inverter with PMOS transistor 318 and NMOS transistor 319. In the signal conditioning path, output $V_x$ of inverter 308 is provided to level-shifter 309, and output $V_y$ of level-shifter 309 is provided to inverter 310.

In operation, startup circuit 300 is configured to transition between two states, as illustrated in Table II below:

TABLE II

| | State 1 | State 2 |
|---|---|---|
| $V_{bg}$ | $<V_{trig}$ | $>V_{trig}$ |
| $V_{OUT}$ | 5 V | 0.5 V |
| $V_x$ | 0.5 V | 5 V |
| $V_y$ | 0 V | 5 V |
| $V_{FLAG}$ | 5 V | 0 V |

In the above example, $V_{FLAG}$ has the opposite logic levels as in circuit 200. It should be noted, however, that the logic value of $V_{FLAG}$ may be arbitrarily chosen, for example, by adding another inverter operably coupled to block 310 or by omitting one of blocks 309 or 310.

In startup circuit 300, when $V_{bg}$ is at 0 V, native NMOS transistor 305 starts to conduct current, which passes through PMOS transistor 303 and is mirrored to PMOS transistor 304 and native PMOS transistor 306, passing through diode 307. Because the voltage between the source of native NMOS transistor 306 and diode 307 is greater than 0 V, the $V_{gs}$ of native NMOS transistor 305 is higher than the $V_{gs}$ of native NMOS transistor 306, which is at 0 V since native NMOS transistor 306 has its gate and source terminals coupled to each other. Accordingly, the current through native NMOS transistor 305 is higher than the current through native NMOS transistor 306, and $V_{OUT}$ rises to $V_{DD}$. Also, when $V_{bg}$ is at 0 V, NMOS transistor 301 is turned off.

Conversely, when $V_{bg}$ is higher than the voltage drop across diode 307, the $V_{gs}$ of native NMOS transistor 305 becomes negative and the current through that transistor becomes less than what native NMOS transistor 306 is capable of sinking to $V_{SS}$. Therefore, the current mirrored by PMOS transistors 303 and 304 is greater than the current that native NMOS transistor 306 is capable to sink with its $V_{gs}$ equal to zero, and the $V_{OUT}$ assumes the voltage value at the node between native NMOS transistor 306 and diode 307—in this example, 0.5 V.

As illustrated, the low currents flowing through startup circuit 300 can cause its transition between states 1 and 2 to be slow. Hence, for startup circuit 300 to be able to provide a quicker response to fast-changing $V_{bg}$ values, NMOS transistors 301 and 302 may be added. In some cases, a capacitor (not shown) may also be added in parallel with native NMOS transistor 305.

Figure 4:
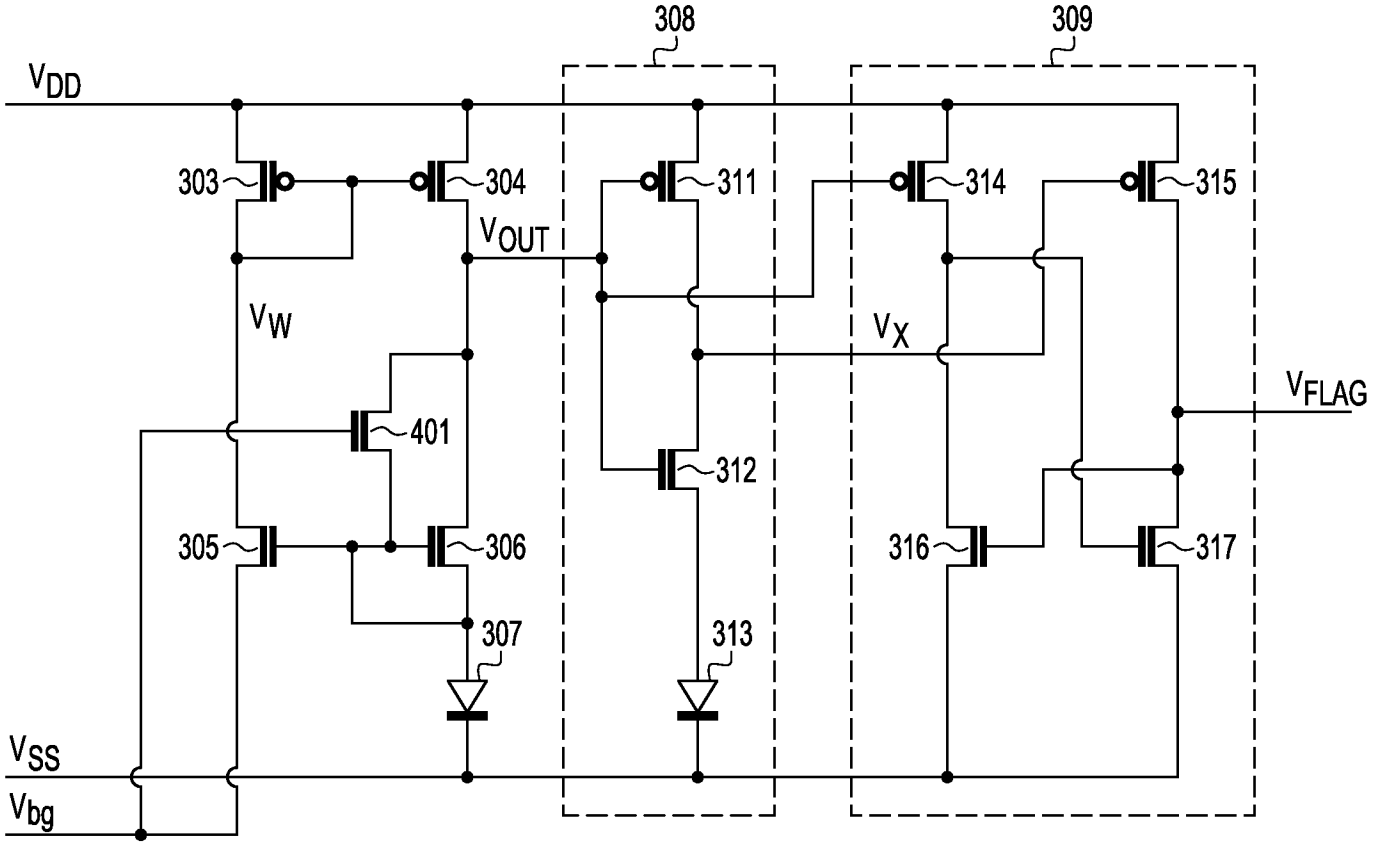
FIG. 4 is a circuit diagram of an example of yet another startup circuit according to some embodiments.

FIG. 4 is a circuit diagram of an example of yet another startup circuit 400. While similar to circuit 300 of FIG. 3, here startup circuit 400 further includes a third native NMOS transistor 401 and inverter 310 is absent. In some implementations, native NMOS transistor 305 may be twice as large as each of transistors 401 or 306.

In operation, startup circuit 400 is configured to transition between two states, as illustrated in Table III below:

TABLE III

| | State 1 | State 2 |
|---|---|---|
| $V_{bg}$ | $<V_{trig}$ | $>V_{trig}$ |
| $V_w$ | 4.5 V | 5 V |
| $V_{OUT}$ | 5 V | 0.5 V |
| $V_x$ | 0.5 V | 5 V |
| $V_{FLAG}$ | 5 V | 0 V |

Similarly as in circuit 300, here when $V_{bg}$ is at 0 V, native NMOS transistor 305 starts to conduct current, which passes through PMOS transistor 303 and is mirrored to PMOS transistor 304 and native PMOS transistor 306, passing through diode 307.

Because the voltage between the source of native NMOS transistor 306 and diode 307 is greater than 0 V, the $V_{gs}$ of native NMOS transistor 305 is higher than the $V_{gs}$ of native NMOS transistor 306, and the $V_{gs}$ of native transistor 401 is negative, thus turning off the latter. Accordingly, the current through native NMOS transistor 305 is higher than the current through native NMOS transistors 401 and 306 combined, and $V_{OUT}$ rises to $V_{DD}$.

Conversely, when $V_{bg}$ is higher than the voltage drop across diode 307, the $V_{gs}$ of native NMOS transistor 305 becomes negative and the $V_{gs}$ of native NMOS transistor 401 becomes positive, hence the current through native NMOS transistor 305 becomes smaller than what native NMOS transistors 401 and 306 are capable to pull down. Therefore, the current mirrored by PMOS transistors 303 and 304 is smaller than the current that native NMOS transistors 401 and 306 are capable to sink, and $V_{OUT}$ drops to the voltage value between native NMOS transistor 306 and diode 307—in this example, 0.5 V.

Here it should be noted that, for startup circuits 300 and 400, the threshold voltage value that causes $V_{OUT}$ to transition is given by the voltage across diode 307 due to the current of native NMOS transistor 306 (or 401 in combination with 306).

In alternative embodiments, diode 307 may be replaced by other devices in order to achieve different threshold voltages. Additionally or alternatively, the node between the source of native NMOS transistor 306 and diode 307 may be coupled to a voltage source in order to set the threshold voltage.

Figure 6:
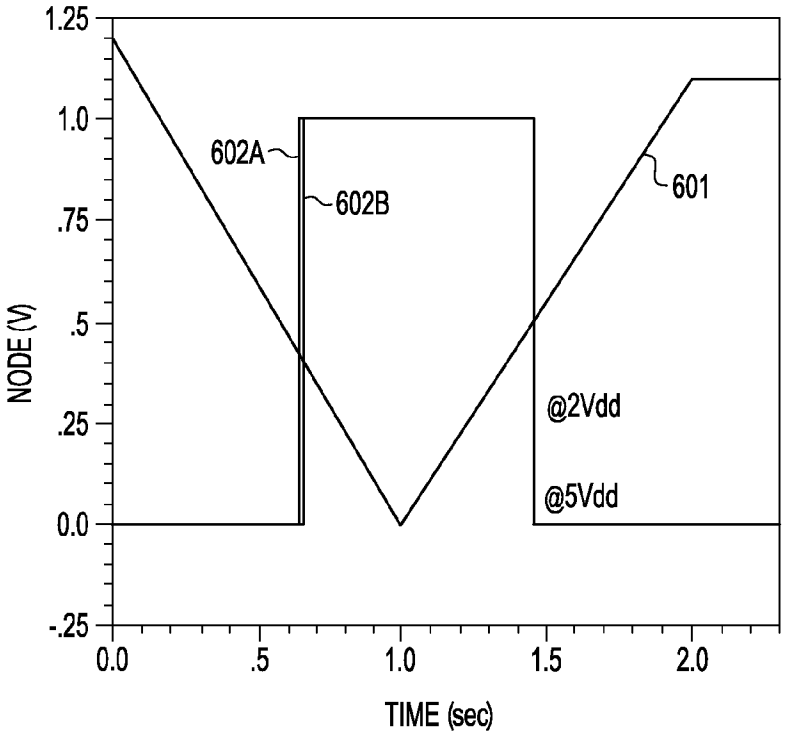
FIGS. 5 and 6 are graphs showing the outputs of different startup circuits as a function of their input voltages according to some embodiments.
Figure 5:
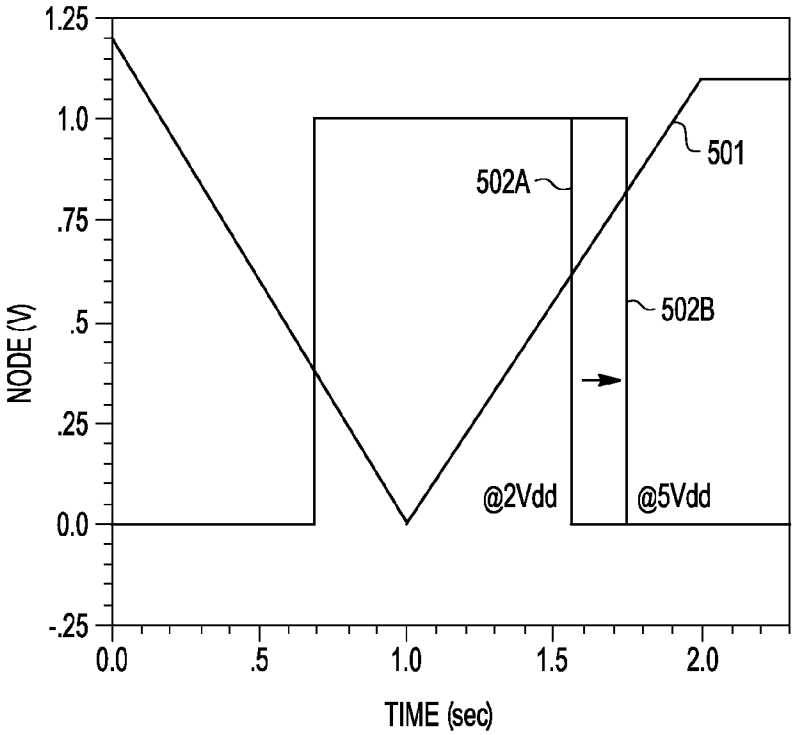

FIGS. 5 and 6 are graphs showing the outputs of different startup circuits as a function of their input voltages according to some embodiments. Particularly, graph 500 shows a normalized $V_{OUT}$ as a function of $V_{bg}$ for startup circuit 200, and graph 600 shows a normalized $V_{OUT}$ as a function of $V_{bg}$ for startup circuits 300 and 400. In both graphs, as $V_{bg}$ 501 and 601 decrease, $V_{OUT}$ 502 A/B and $V_{OUT}$ 602 A/B go from 0 V to $V_{DD}$. Then, as $V_{bg}$ 501 and 601 decrease, $V_{OUT}$ 502A/B and $V_{OUT}$ 602 A/B go from $V_{DD}$ to 0 V. However, $V_{OUT}$ is more sensitive to the value of $V_{DD}$ in startup circuit 200 than in startup circuits 300 and 400—that is, curves 602A ($V_{DD}$=2 V) and 602B ($V_{DD}$=5 V) approximately overlap, whereas there is a spread between curves 502A ($V_{DD}$=2 V) and 502B ($V_{DD}$=5 V). In other words, startup circuit 200 shows more variation with supply voltage than startup circuits 300 and 400.

FIG. 7 is a graph 700 showing the current consumption of different startup circuits as a function of their input voltages according to some embodiments. Particularly, $V_{bg}$ is shown as curve 701, the current consumed by startup circuit 200 is shown by curve 702, and the current consumed by startup circuit 300 or 400 is shown by curve 703. Therefore, it the power consumption of startup circuit 200 occurs at the transitions points when $V_{OUT}$ switches from a logic low to a logic high and vice-versa, while the power consumption of startup circuit 300 occurs so long as $V_{OUT}$ is at a logic high.

Thus it is shown that a number of startup circuits with native transistors are described in connection with FIGS. 2-4. In some embodiments, each of startup circuits 200-400 may be configured to provide a signal to a bandgap circuit in response to $V_{bg}$ being smaller than $V_{trig}$ to help initialize and/or stabilize the bandgap circuit's output. Additionally or alternatively, each of startup circuits 200-400 may be configured to provide a flag indicative of whether $V_{bg}$ is above or below $V_{trig}$. Moreover, when startup circuits 200-400 are operating in a first state (that is, when $V_{bg}$ is below $V_{trig}$), its native NMOS transistors are conducting and help set the initial state of $V_{OUT}$. Conversely, when startup circuits 200-400 are operating a second state (that is, when $V_{bg}$ is above $V_{trig}$), $V_{OUT}$ is at a logic low, and because the source terminals of their native NMOS transistors are at $V_{trig}$ or higher, each respective circuit is capable of turning off its native NMOS transistors. Accordingly, startup circuits 200-400 may be particularly well suited for use in low power applications.

In many implementations, the systems and methods disclosed herein may be incorporated into a wide range of electronic devices including, for example, computer systems or Information Technology (IT) products such as servers, desktops, laptops, switches, routers, etc.; telecommunications hardware; consumer devices or appliances such as mobile phones, tablets, television sets, cameras, sound systems, etc.; scientific instrumentation; industrial robotics; medical or laboratory electronics such as imaging, diagnostic, or therapeutic equipment, etc.; transportation vehicles such as automobiles, buses, trucks, trains, watercraft, aircraft, etc.; military equipment, etc. More generally, these systems and methods may be incorporated into any device or system having one or more electronic parts or components.

Figure 8:
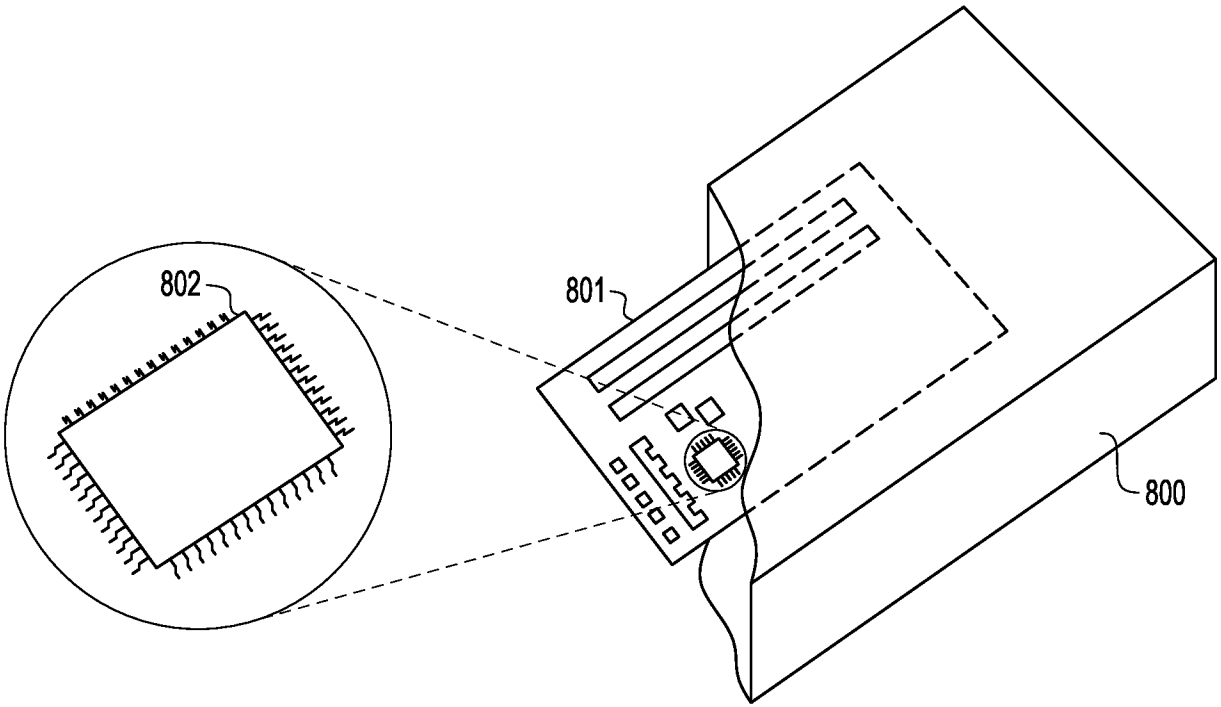
FIG. 8 is a diagram of an example of a Printed Circuit Board (PCB) of a device having one or more electronic chips, according to some embodiments.

Turning to FIG. 8, a block diagram of electronic device 800 is depicted. In some embodiments, electronic device 800 may be any of the aforementioned electronic devices, or any other electronic device. As illustrated, electronic device 800 includes one or more Printed Circuit Boards (PCBs) 801, and at least one of PCBs 801 includes one or more chips 802. In some implementations, one or more ICs within chip 802 may implement one or more startup circuits such as those discussed above.

Examples of IC(s) that may be present within chip 802 may include, for instance, a System-On-Chip (SoC), an Application Specific Integrated Circuit (ASIC), a Digital Signal Processor (DSP), a Field-Programmable Gate Array (FPGA), a processor, a microprocessor, a controller, a microcontroller (MCU), a Graphics Processing Unit (GPU), or the like. Additionally or alternatively, IC(s) may include a memory circuit or device such as, for example, a Random Access Memory (RAM), a Static RAM (SRAM), a Magnetoresistive RAM (MRAM), a Nonvolatile RAM (NVRAM, such as "FLASH" memory, etc.), and/or a Dynamic RAM (DRAM) such as Synchronous DRAM (SDRAM), a Double Data Rate RAM, an Erasable Programmable ROM (EPROM), an Electrically Erasable Programmable ROM (EEPROM), etc. Additionally or alternatively, IC(s) may include one or more mixed-signal or analog circuits, such as, for example, Analog-to-Digital Converter (ADCs), Digital-to-Analog Converter (DACs), Phased Locked Loop (PLLs), oscillators, filters, amplifiers, etc. Additionally or alternatively, IC(s) may include one or more Micro-ElectroMechanical Systems (MEMS), Nano-ElectroMechanical Systems (NEMS), or the like.

Accordingly, an IC within chip 802 may include a number of different portions, areas, or regions. These various portions may include one or more processing cores, cache memories, internal bus(es), timing units, controllers, analog sections, mechanical elements, etc. In various embodiments, these different portions, areas, or regions may each be in a different power domain, and therefore may each be coupled to a different reference voltage circuit assisted by one or more startup circuits.

Generally speaking, chip 802 may include an electronic component package configured to be mounted onto PCB 801 using any suitable packaging technology such as, for example, Ball Grid Array (BGA) packaging or the like. In some applications, PCB 801 may be mechanically mounted within or fastened onto electronic device 800. It should be noted that, in certain implementations, PCB 801 may take a variety of forms and/or may include a plurality of other elements or components in addition to chip 802. It should also be noted that, in some embodiments, PCB 801 may not be used.

Although the example of FIG. 8 shows electronic chip 802 in monolithic form, it should be understood that, in alternative embodiments, the systems and methods described herein may be implemented with discrete components. For example, in some cases, one or more logic gates, multiplexers, latches, flip-flops, etc. may be located outside of chip 802, and one or more of these external components may be operably coupled to an IC fabricated within chip 802.

As discussed above, in an illustrative, non-limiting embodiment, a startup circuit may include a first inverter configured to receive a bandgap voltage ($V_{bg}$) from a bandgap reference circuit and to produce an output voltage ($V_{OUT}$); and a second inverter operably coupled to the first inverter to form a latch, the latch configured to maintain a value of $V_{OUT}$, the second inverter including a native transistor, the native transistor having a gate terminal coupled to $V_{OUT}$ and a source terminal coupled to $V_{bg}$.

In some implementations, the native transistor may be configured to be conductive in response to $V_{OUT}$ being at a logic high and $V_{bg}$ being below a trigger voltage value ($V_{trig}$), and it may be configured to be non-conductive in response to $V_{OUT}$ being at a logic low and $V_{bg}$ being above $V_{trig}$. Additionally or alternatively, the second inverter may be configured to produce a flag signal ($V_{FLAG}$) indicative of whether $V_{bg}$ is above $V_{trig}$. For example, $V_{FLAG}$ may be set to a logic low in response to $V_{bg}$ being below $V_{trig}$ and to a logic high in response to $V_{bg}$ rising above $V_{trig}$.

Moreover, the second inverter may include another native transistor. The second inverter may also include a current mirror configured to rearm the startup circuit in response to $V_{bg}$ falling below $V_{trig}$. The power consumption of the startup circuit may be equal to zero, excluding leakage effects, at all times except during $V_{OUT}$'s transitions between high and low logic values.

In another illustrative, non-limiting embodiment, an electronic device may include a bandgap circuit configured to output $V_{bg}$, and a startup circuit operably coupled to the bandgap circuit, the startup circuit configured to configured to produce $V_{FLAG}$ indicative of whether $V_{bg}$ has risen above $V_{trig}$ or fallen below $V_{trig}$, the startup circuit further including a first current mirror and a second current mirror, the first current mirror having two normal transistors and the second current mirror having two native transistors. Additionally or alternatively, the startup circuit may be configured to output a voltage $V_{OUT}$ configured to change in response to $V_{bg}$.

In some implementations, $V_{OUT}$ may be set to a logic high in response to $V_{bg}$ being below the threshold value, and to a logic low in response to $V_{bg}$ rising above $V_{trig}$. Also, one of the two native transistors may be configured to have a voltage applied at its source terminal to determine $V_{trig}$.

The startup circuit may also include a first inverter operably coupled to a node between the first and second current mirrors, a level shifter operably coupled to the first inverter, and a second inverter operably coupled to the level shifter, the second inverter configured to produce $V_{FLAG}$. For example, $V_{FLAG}$ may be set to a logic high in response to $V_{bg}$ being below $V_{trig}$, and to a logic low in response to $V_{bg}$ rising above $V_{trig}$.

In yet another illustrative, non-limiting embodiment, a method may include receiving $V_{bg}$ at a startup circuit, and outputting $V_{OUT}$ configured to change in response to $V_{bg}$ rising above $V_{trig}$ or falling below $V_{trig}$, where the power consumption of the startup circuit is based at least in part upon a voltage value applied to a source terminal of a native transistor within the startup circuit. The startup circuit may include a first inverter configured to receive $V_{bg}$ and a second inverter operably coupled to the first inverter to form a latch, the second inverter including the native transistor. Additionally or alternatively, the startup circuit may include a first current mirror and a second current mirror, the first current mirror having two normal transistors and the second current mirror having the native transistor.

In some implementations, $V_{OUT}$ may be set to a logic high in response to $V_{bg}$ falling below $V_{trig}$, and to a logic low in response to $V_{bg}$ rising above $V_{trig}$. The method may also comprise generating ($V_{FLAG}$) indicative of whether $V_{bg}$ has risen above $V_{trig}$. In some cases, $V_{FLAG}$ may be set to a first logic value in response to $V_{bg}$ falling below $V_{trig}$, and to a second logic value in response to $V_{bg}$ rising above $V_{trig}$.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A startup circuit, comprising:

a first inverter configured to receive a bandgap voltage ($V_{bg}$) from a bandgap reference circuit and to produce an output voltage ($V_{OUT}$); and a second inverter operably coupled to the first inverter to form a latch, wherein the latch is configured to maintain a value of $V_{OUT}$, wherein the second inverter includes a native transistor, wherein the native transistor has a gate terminal coupled to $V_{OUT}$ and a source terminal coupled to $V_{bg}$, wherein the native transistor is configured to be conductive in response to $V_{OUT}$ being at a logic high and non-conductive in response to $V_{OUT}$ being at a logic low, wherein the native transistor is configured to be conductive in response to $V_{bg}$ being below a trigger voltage value ($V_{trig}$) and non-conductive in response to $V_{bg}$ being above $V_{trig}$, and wherein the bandgap reference circuit is correctly biased when $V_{bg}$ is above $V_{trig}$.

2. The startup circuit of claim 1, wherein the power consumption of the startup circuit is equal to zero, excluding leakage effects, at all times during which the native transistor is non-conductive.

3. The startup circuit of claim 1, the second inverter configured to produce a flag signal ($V_{FLAG}$) indicative of whether $V_{bg}$ is above a trigger voltage value ($V_{trig}$).

4. The startup circuit of claim 3, wherein $V_{FLAG}$ is set to a logic low in response to $V_{bg}$ being below $V_{trig}$, and wherein $V_{FLAG}$ is set to a logic high in response to $V_{bg}$ rising above $V_{trig}$.

5. The startup circuit of claim 1, the second inverter including another native transistor.

6. The startup circuit of claim 1, wherein the second inverter includes a current mirror configured to rearm the startup circuit in response to $V_{bg}$ falling below $V_{trig}$.

7. The startup circuit of claim 1, wherein the power consumption of the startup circuit is equal to zero, excluding leakage effects, at all times except during $V_{OUT}$'S transitions between high and low logic values.

8. An electronic device, comprising:

a bandgap circuit configured to output a bandgap voltage ($V_{bg}$); and a startup circuit operably coupled to the bandgap circuit, wherein the startup circuit is configured to produce a flag signal ($V_{FLAG}$) indicative of whether $V_{bg}$ has risen above a trigger voltage value ($V_{trig}$) or fallen below $V_{trig}$, and wherein the bandgap circuit is correctly biased when $V_{bg}$ meets or surpasses $V_{trig}$, the startup circuit further comprising:

a first current mirror and a second current mirror, the first current mirror having two normal transistors and the second current mirror having two native transistors, wherein the second current mirror is configured to be conductive in response to $V_{bg}$ being below $V_{trig}$ and non-conductive in response to $V_{bg}$ being above $V_{trig}$, and wherein the power consumption of the startup circuit is equal to zero, excluding leakage effects, at all times during which the second current mirror is non-conductive.

9. The electronic device of claim 8, the startup circuit configured to output a voltage $V_{OUT}$ configured to change in response to $V_{bg}$.

10. The electronic device of claim 9, wherein $V_{OUT}$ is set to a logic high in response to $V_{bg}$ being below the threshold value, and wherein $V_{OUT}$ is set to a logic low in response to $V_{bg}$ rising above $V_{trig}$.

11. The electronic device of claim 8, wherein one of the two native transistors is configured to have a voltage applied at its source terminal to determine $V_{trig}$.

12. The electronic device of claim 8, the startup circuit further comprising a first inverter operably coupled to a node between the first and second current mirrors, a level shifter operably coupled to the first inverter, and a second inverter operably coupled to the level shifter, the second inverter configured to produce $V_{FLAG}$.

13. The electronic device of claim 12, wherein $V_{FLAG}$ is set to a logic high in response to $V_{bg}$ being below $V_{trig}$, and wherein $V_{FLAG}$ is set to a logic low in response to $V_{bg}$ rising above $V_{trig}$.

14. A method, comprising:

receiving, at a startup circuit, a bandgap voltage ($V_{bg}$) provided by a bandgap circuit; and outputting, by the startup circuit, a voltage ($V_{OUT}$) configured to change in response to $V_{bg}$ rising above a trigger voltage value ($V_{trig}$) or falling below $V_{trig}$, wherein the startup circuit includes a native transistor having a gate terminal coupled to $V_{OUT}$ and a source terminal coupled to $V_{bg}$, wherein the native transistor is configured to be conductive in response to $V_{OUT}$ being at a logic high and non-conductive in response to $V_{OUT}$ being at a logic low, wherein the native transistor is configured to be conductive in response to $V_{bg}$ being below a trigger voltage value ($V_{trig}$) and non-conductive in response to $V_{bg}$ being above $V_{trig}$, wherein the bandgap circuit is correctly biased when $V_{bg}$ meets or surpasses $V_{trig}$, and wherein the power consumption of the startup circuit is equal to zero, excluding leakage effects, at all times during which the native transistor is non-conductive.

15. The method of claim 14, wherein the startup circuit includes a first inverter configured to receive $V_{bg}$ and a second inverter operably coupled to the first inverter to form a latch, the second inverter including the native transistor.

16. The method of claim 14, wherein the startup circuit includes a first current mirror and a second current mirror, the first current mirror having two normal transistors and the second current mirror having the native transistor.

17. The method of claim 14, wherein $V_{OUT}$ is set to a logic high in response to $V_{bg}$ falling below $V_{trig}$, and wherein $V_{OUT}$ is set to a logic low in response to $V_{bg}$ rising above $V_{trig}$.

18. The method of claim 14, further comprising generating, by the startup circuit, a flag signal ($V_{FLAG}$) indicative of whether $V_{bg}$ has risen above $V_{trig}$.

19. The method of claim 18, wherein $V_{FLAG}$ is set to a first logic value in response to $V_{bg}$ falling below $V_{trig}$, and wherein $V_{FLAG}$ is set to a second logic value in response to $V_{bg}$ rising above $V_{trig}$.

* * * * *